US010390131B2

(12) United States Patent
Sheaffer et al.

(10) Patent No.: US 10,390,131 B2
(45) Date of Patent: Aug. 20, 2019

(54) RECORDING MUSICAL INSTRUMENTS USING A MICROPHONE ARRAY IN A DEVICE

(71) Applicant: Apple Inc., Cupertino, CA (US)

(72) Inventors: Jonathan D. Sheaffer, Santa Clara, CA (US); Darius A. Satongar, Santa Clara, CA (US); Joshua D. Atkins, Los Angeles, CA (US); Martin E. Johnson, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/721,654

(22) Filed: Sep. 29, 2017

(65) Prior Publication Data

US 2019/0104359 A1 Apr. 4, 2019

(51) Int. Cl.

| | |
|---|---|
| ***H04R 5/00*** | (2006.01) |
| ***H04R 3/00*** | (2006.01) |
| ***H04R 1/40*** | (2006.01) |
| ***H04R 1/08*** | (2006.01) |
| ***H04R 1/04*** | (2006.01) |

(52) U.S. Cl.

CPC ..... *H04R 3/005* (2013.01); *H04R 1/04* (2013.01); *H04R 1/083* (2013.01); *H04R 1/406* (2013.01); *H04R 2201/401* (2013.01); *H04R 2499/11* (2013.01)

(58) Field of Classification Search

CPC ..... H04R 3/005; H04R 1/04; H04R 1/083; H04R 1/406; H04R 2201/401; H04R 2499/11; H04R 1/403; H04R 29/00; H04R 25/305; H04R 1/326; H04S 1/002; H04S 3/002

USPC ..... 381/92, 17, 58, 123, 303, 104, 26

See application file for complete search history.

(56) References Cited

U.S. PATENT DOCUMENTS

| | | | | |
|---|---|---|---|---|
| 2006/0109988 | A1* | 5/2006 | Metcalf | H04S 3/002 381/104 |
| 2009/0225993 | A1 | 9/2009 | Cvetkovic | |
| 2012/0128160 | A1* | 5/2012 | Kim | G11B 20/00 381/17 |
| 2014/0198918 | A1 | 7/2014 | Li et al. | |
| 2015/0146897 | A1* | 5/2015 | Yoshizawa | H04S 1/002 381/303 |
| 2015/0304786 | A1* | 10/2015 | Partio | H04R 25/305 381/58 |
| 2017/0318387 | A1* | 11/2017 | Ray | H04R 1/326 |

* cited by examiner

*Primary Examiner* — Paul Kim
*Assistant Examiner* — Ubachukwu A Odunukwe
(74) *Attorney, Agent, or Firm* — Womble Bond Dickinson (US) LLP

(57) ABSTRACT

A microphone array included in a portable electronic device is used to generate various virtual studio microphones by combining one or more microphone signals to produce one or more acoustic pickup beams. An error is determined in a position of the microphone array relative to an audio source to be recorded. An interface is displayed to instruct a user on repositioning the microphone array relative to the instrument and the instrument is recorded using the repositioned microphone array.

21 Claims, 9 Drawing Sheets

RECORDING MUSICAL INSTRUMENTS USING A MICROPHONE ARRAY IN A DEVICE

FIELD

The disclosure herein relates to audio signal processing methods and systems, and in particular to recording musical instruments using a microphone array included in a portable electronic device.

BACKGROUND

Audio sources such as musical instruments are sometimes recorded in a professional studio where a sound engineer has access to a range of microphones. These microphones typically have specific characteristics that make them suitable for different applications (e.g., recording different types of instruments). Depending on the type of instrument being recorded, the engineer may select a microphone with an appropriate directivity pattern and may position the microphone at a particular point in space to capture the desired sound characteristics of the instrument. (This technique may be referred to in this disclosure as a "close-mic technique".) The engineer may also use a combination of two or more microphones to create a sensation of enhanced spatial width. (This technique may be referred to in this disclosure as a "stereo-mic technique".)

BRIEF DESCRIPTION OF THE DRAWINGS

The aspects herein are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect, and not all elements in the figure may be required for a given aspect.

DETAILED DESCRIPTION

Several aspects of the invention with reference to the appended drawings are now explained. Whenever aspects are not explicitly defined, the scope of the invention is not limited only to the parts shown, which are meant merely for the purpose of illustration. Also, while numerous details are set forth, it is understood that some aspects of the invention may be practiced without these details. In other instances, well-known circuits, structures, and techniques have not been shown in detail so as not to obscure the understanding of this description.

Generally, an aspect herein aims to use an array of microphones mounted on a portable electronic device (e.g., mobile phone or a tablet computer) to emulate the techniques used in a professional recording studio. The raw signals from the array of microphones are combined to define acoustic pick up beams that emulate varying directivity patterns (similar to patterns of professional recording microphones) and that have different look-directions (similar to angles of professional recording microphones). Various professional recording microphones may be emulated by the single microphone array based on the type of audio source to be recorded. Articulation by the musician of an instrument and genre of the music to the recorded may also be considered. These factors (e.g, type of audio source, articulation, genre) may be determined by the portable device by analyzing audio signals from the microphones and/or by using sensors (e.g., camera), or may be input by a user.

In one aspect, an interface is provided to instruct a user on device placement to place the device in a particular position to record the audio source, such that the user does not need the expertise of a sound engineer in order to simulate a professional studio environment. The interface may also be configured to receive input from a user, such that it is interactive. The interface may therefore be manual, automated, or semi-automated. The interface may provide instructions and feedback to the user by overlaying positioning instructions on top of a video feed of the instrument in an augmented-reality fashion, by using haptic feedback, or by using audio feedback.

Figure 1:
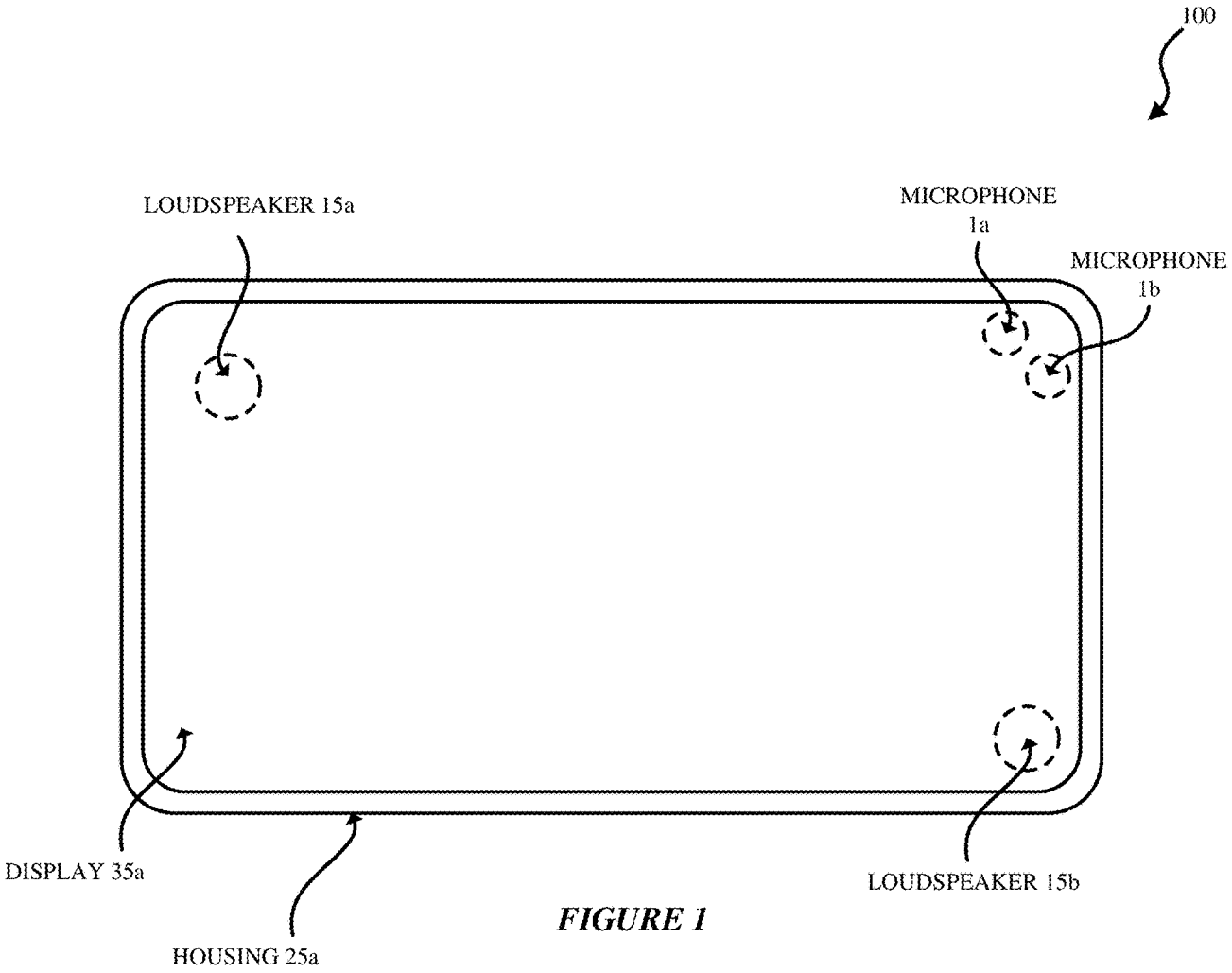
FIG. 1 illustrates an example for explaining a portable device including a microphone array according to a first example aspect.

FIG. 1 illustrates an example for discussing a portable device including a microphone array according to a first example aspect. Portable device 100 may be any electronic device that includes two or more microphones (e.g., a microphone array), such as a tablet computer or a mobile phone handset. Device 100 is portable and thus can be easily handled, positioned and moved by the user. Device 100 can also operate in many different environments. The housing 25*a* of device 100 contains a number of microphones 1 (two microphones 1*a* and 1*b* are illustrated in FIG. 1). In one aspect, the housing of the device 100 may also contain one or more loudspeakers 15 (two loudspeakers 15*a* and 15*b* are illustrated in FIG. 1). In general, microphones 1 are used to pick up signals from sound sources in the environment in and around the device 100. The loudspeakers 15 are used to play back signals from sound sources outside the surrounding environment. Display 35*a* displays images captured by a camera. In one aspect, display 35*a* displays an interface generated to instruct a user on device placement.

Microphones 1 (or individually, microphones 1*a*, 1*b*) may be integrated within the housing 25*a* of the device 100, and may have a fixed geometrical relationship to each other. In the example depicted in FIG. 1, the microphones can be positioned on different surfaces, e.g. microphone 1*a* can be on the front (screen) surface of the device and microphone 1*b* may be on the back surface of the device. This is just one example arrangement; however it should be understood that other arrangements of microphones that may be viewed collectively as a microphone array whose geometrical relationship may be fixed and "known" at the time of manufacture are possible, e.g. arrangements of two or more microphones in the housing of a mobile electronic device (e.g., mobile phone) or a computer (e.g., a tablet computer). Other example arrangements are discussed in connection with FIG. 2 and FIG. 3.

In one aspect, beamforming may also be applied to the microphone signals. The signals from the microphones 1 are digitized, and made available simultaneously or parallel in time, to a digital processor (e.g., processor 802 of FIG. 8 or processor 902 of FIG. 9) that can utilize any suitable combination of the microphone signals in order to produce a number of acoustic pick up beams. The microphones 1 including their individual sensitivities and directivities may be known and considered when configuring or defining each of the beams, such that the microphones 1 are treated as a microphone array.

In particular, the signals from the microphones on the phone can be combined to yield beamformers, emulating varying directivity patterns (similar to the desired patterns of professional recording microphones) and, depending on their arrangement, with different look-directions (similar to the angles of professional recording microphones). Thus, coordination and design of the beams may include shaping the beams and directing the beams to pick up a desired audio source (e.g., musical instrument or voice) for recording. In one aspect, a subset of the microphones used to produce the beam is also identified or assigned.

The configuration of the beams may be based on a number of factors including the type of instrument to be recorded (e.g, guitar, clarinet, piano, etc). In one aspect, the type of instrument being recorded may be determined using a sensor (e.g., camera). In one aspect, the type of instrument being recorded may be input by a user. Playing style or articulation by the musician of the instrument may also be considered when configuring the beams. For example, the music being recorded may be analyzed by the processor to determine whether a transition or continuity on a single sound or between multiple sounds in the music being recorded is short, long, loud, soft, etc. Genre of the music to the recorded may also be considered.

Other factors in configuration of the beams may include the sensitivities and directivities of the microphones, the positions of the microphones, the geometrical relationship between the microphones, the location of the audio source (e.g., musical instrument) relative to the positions of the microphones, the direction of the audio signal from the audio source relative to the position of the microphones, the shape of the housing of the portable device. One or more sensors (e.g., camera) may be included in the device 100 in order to determine the position of the device 100 relative to the instrument being recorded. In one aspect, these factors are also analyzed in order to determine which microphones should be assigned to produce a beam to pick up the audio signals from the audio source.

Figure 3:
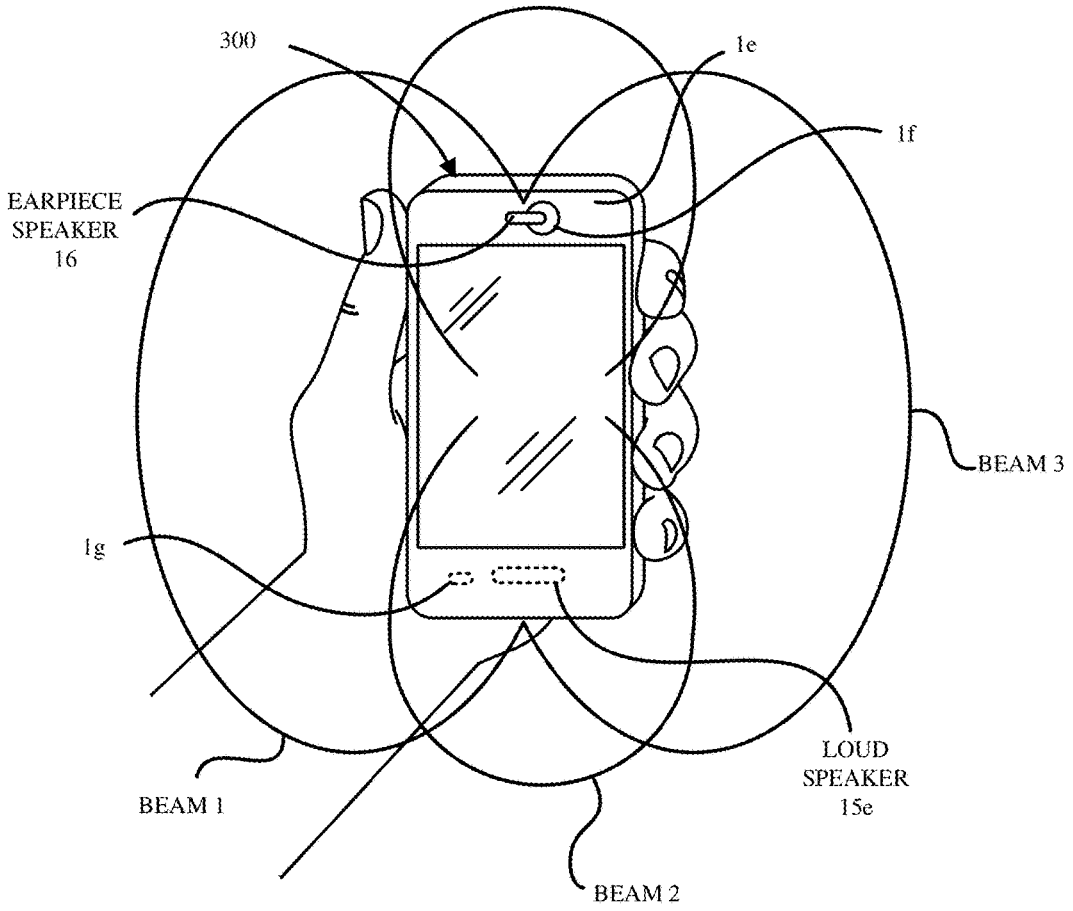
FIG. 3 illustrates a mobile phone hand set for explaining an example portable device, overlaid with some example beams, according to an aspect.

FIG. 3 illustrates another example of a portable device with some example beams (beam 1, beam 2, beam 3). In the example of FIG. 3, the portable device is implemented as a mobile phone handset 300 having three microphones integrated within the housing, namely a bottom microphone 1*g* and two top microphones 1*e*, 1*f*. The microphone 1*e* may be referred to as a top reference microphone whose sound sensitive surface is open on the rear face of the handset, while the microphone if has its sound sensitive surface open to the front and is located adjacent to an earpiece speaker 16. The handset also has a loudspeaker 15*e* located closer to the bottom microphone 1*g* as shown. The handset also includes a display. In the aspect of FIG. 3, microphones 1*e*, 1*f* and 1*g* have a fixed geometrical relationship to each other. The mobile phone handset 300 may use any one or more of three microphones 1*e*, 1*f*, 1*g* to produce one or more respective microphone signals that are used to produce one or more acoustic pick up beams. Although FIG. 3 shows three microphones integrated within the housing of the portable device, in other aspects, other numbers of microphones are possible, such as four or more. Other arrangements of microphones that may be viewed collectively as a microphone array or cluster whose geometrical relationship may be fixed and "known" at the time of manufacture are possible, e.g. arrangements of two or more microphones in the housing of a computer (e.g., a tablet computer).

Three example beams are depicted in FIG. 3 (namely, beam 1, beam 2, beam 3), which may be produced using a combination of at least two microphones, for example the bottom microphone 1*g* and the top reference microphone 1*e*. In one aspect, each audio channel or "beam" can be defined as a linear combination of the raw signals available from the multiple microphones. The beams may be computed as a combination (e.g. weighted sum) of two or more microphone signals from two or more of the microphones. More generally, the weighting could be implemented by a linear filter, where different filters run on the two microphones before the outputs are summed to produce a beam. Various beams of other shapes and using other combinations of the microphones (including ones that are not shown) are possible.

The portable device may therefore perform beamforming to produce the appropriate beams for recording a musical instrument by coordinating one or more of the following parameters as instructed by the beam analyzer: a shape of the beam (pattern), a general direction of the beam (look-direction), and which microphones in the microphone array will be assigned to produce the beam.

Figure 2:
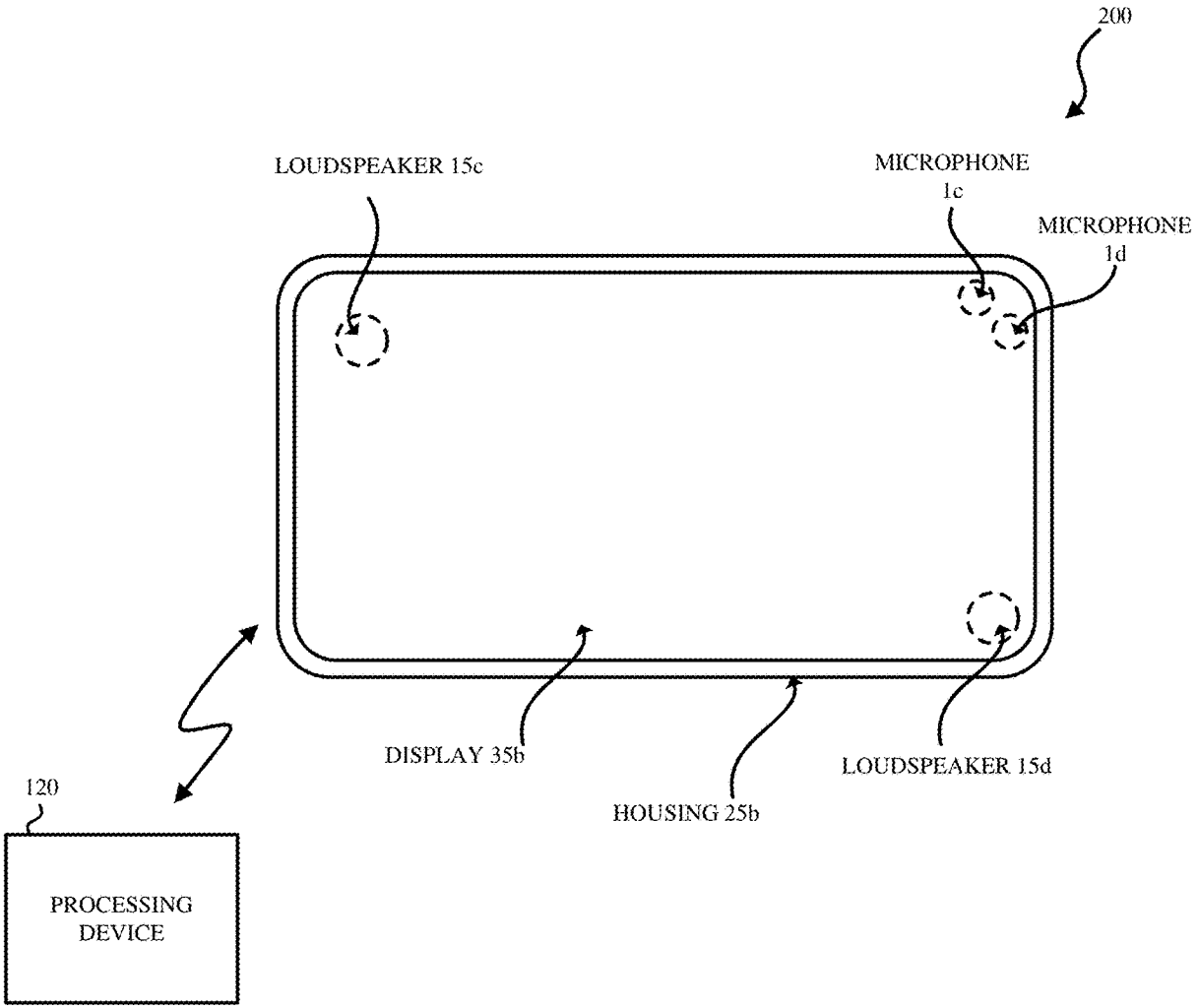
FIG. 2 illustrates an example for explaining a portable device including a microphone array and a processing device according to a second example aspect.

Turning to FIG. 2, a second example aspect is discussed in connection with FIG. 2, in which a portable device is used in connection with a separate processing device. In particular, portable device 200 is similar to portable device 100 of FIG. 1, and may be any electronic device that includes two or more microphones (e.g., a microphone array), such as a tablet computer or a mobile phone handset. Device 200 is portable and thus can be easily handled, positioned and moved by the user. The housing 25*b* of device 200 contains a number of microphones 1 (two microphones 1*c* and 1*d* are illustrated in FIG. 2). Microphones 1 may be integrated within the housing 25*b* of the device 200, and may have a fixed geometrical relationship to each other. In one aspect, the housing of the device 200 may also contain one or more loudspeakers 15 (two loudspeakers 15*c* and 15*d* are illustrated in FIG. 2). Similar to device 100, the signals from the microphones 1 are digitized, and made available simultaneously or parallel in time, to a digital processor (e.g., processor 802 of FIG. 8 or processor 902 of FIG. 9) that can utilize any suitable combination of the microphone signals in order to produce a number of acoustic pick up beams.

Display 35*b* displays images captured by a camera. In one aspect, display 35*b* displays an interface generated to instruct a user on device placement.

Portable device 200 is communicatively coupled to processing device 220, either wirelessly or via a wire. Processing device 220 may perform some or all of the processing for generation of the virtual studio microphone (using the microphone signals to produce the acoustic pick up beams) and for generation of the interface (to instruct a user on device placement), based on factors that may be sensed by the device or input by the user. In contrast, in the aspect of FIG. 1, all of the processing is performed by the portable device 100. Some examples of generating the virtual studio microphone are discussed in connection with FIG. 5A, FIG. 5B, and FIG. 5C. Some examples of generating the interface are discussed in connection with FIG. 6A and FIG. 6B.

Figure 4A:
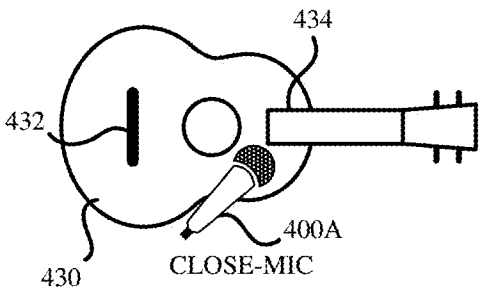
FIG. 4A to FIG. 4C are representational views for explaining typical recording techniques that may be used by a professional sound engineer.
Figure 4B:
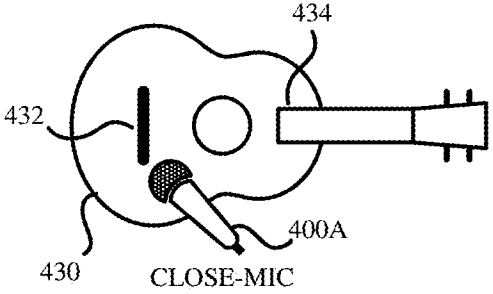
Figure 4C:
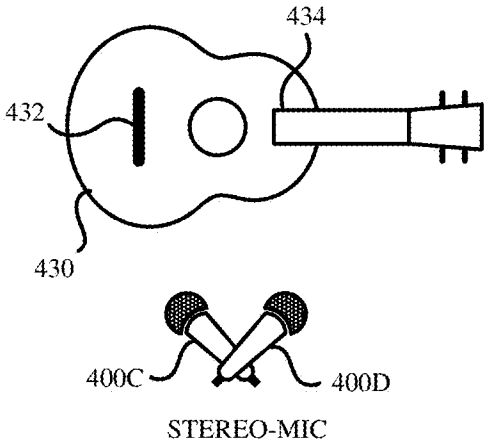

Before turning to these figures, FIG. 4A, FIG. 4B and FIG. 4C will be discussed to explain various typical recording techniques that are typically used by a professional sound engineer. One characteristic of a music recording microphone (also referred to herein as a professional recording microphone) is its directivity pattern, which describes how sensitive is it is to different directions. Since every musical instrument and musician articulation results in a different radiation of sound waves around the instrument, it is desirable to find a microphone whose directivity pattern is favorable in context of that particular recording scenario. For example, as seen in FIG. 4A, an acoustic guitar 430 is recorded with a close cardioid microphone 400A (e.g., microphone having a cardioid polar pattern) close to the bridge 434 to emphasize the strumming sounds of the player's fingers. Another important aspect of music recording, is the angle at which the microphone is placed relative to the instrument. For example, if the player is using a pick, then the sound engineer might want to use the same microphone 400A but pointing to the body 432 of the guitar 430 to de-emphasize the picking sounds. Such an example application is shown in FIG. 4B.

In contrast to close-mic techniques, in some situations the sound engineer may want to record an instrument together with the ambience (reverberation) of the room. This is particularly desirable for string and woodwind instruments, which benefit from room reverberation. In such situations, it is often desirable to conduct a stereo recording, which captures the spaciousness of the acoustic environment. FIG. 4C shows an example of recording an acoustic guitar 430 using microphones 400C and 400D having a stereo mic configuration known as near-coincident cardioids. This configuration is composed of two microphones of cardioid directivity crossed at a +−45 degrees angle. It should be noted that other directivities, mic placements and stereo configurations (for example coincident, spaced, and matrixed techniques) may be applied.

An array of microphones on a consumer electronics device, such as a phone or a tablet, facilitates a means for various spatial signal processing algorithms. In turn, using such algorithms it is possible to emulate the microphone techniques depicted in FIG. 4A, FIG. 4B, and FIG. 4C. In particular, the signals from the microphones on the phone or tablet can be combined to yield beamformers, emulating varying directivity patterns (similar to the desired patterns of the professional recording microphones) and, depending on their arrangement, with different look-directions (similar to the angles of the professional recording microphones).

Figure 5A:
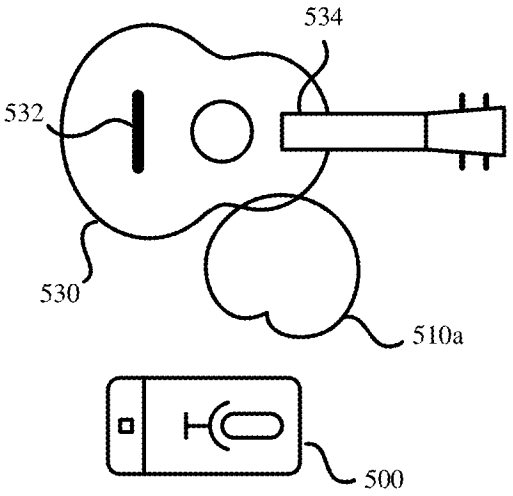
FIG. 5A to 5C are representational views for explaining generation of various virtual studio microphones by a microphone array included in a portable electronic device according to an aspect.
Figure 5B:
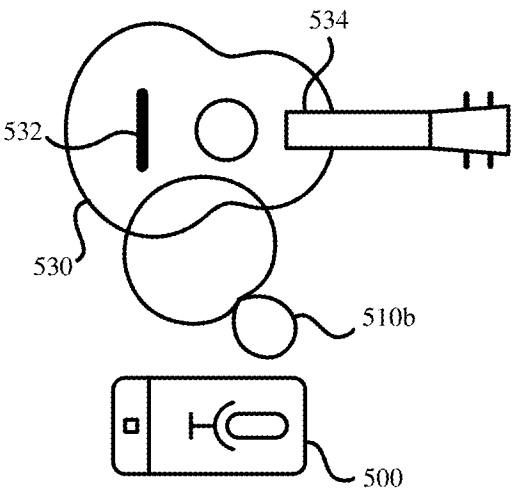
Figure 5C:
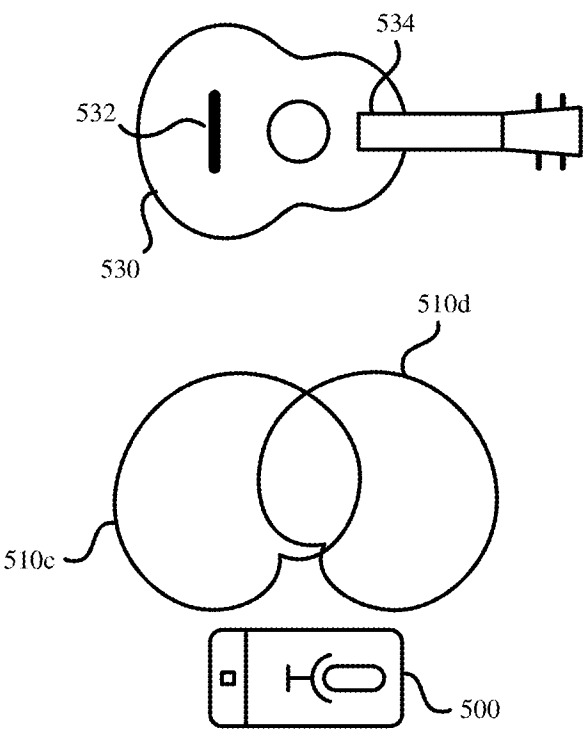

FIG. 5A, FIG. 5B and FIG. 5C are representational views for explaining generation by portable device 500 of various virtual studio microphones for recording acoustic guitar 530 having body 532 and bridge 534. The portable device 500 includes a microphone array. FIG. 5A and FIG. 5B illustrate two microphone placements which require different directivity patterns as well as look-directions, loosely corresponding to the real microphones in FIG. 4A and FIG. 4B respectively. In particular, if the device 500 determines based on the factors of the recording scenario that the virtual microphone should be directed toward bridge 534, the microphone array of device 500 produces beam 510*a*. On the other hand, if the device 500 determines based on the factors of the recording scenario that the virtual microphone should be directed toward body 532, the microphone array of device 500 produces beam 510*b*. In addition, a number of virtual studio microphones can be generated from a single microphone array, which facilitates emulating a stereo microphone for ambient recording using beams 510*c* and 510*d*, as shown in FIG. 5C.

Figure 7:
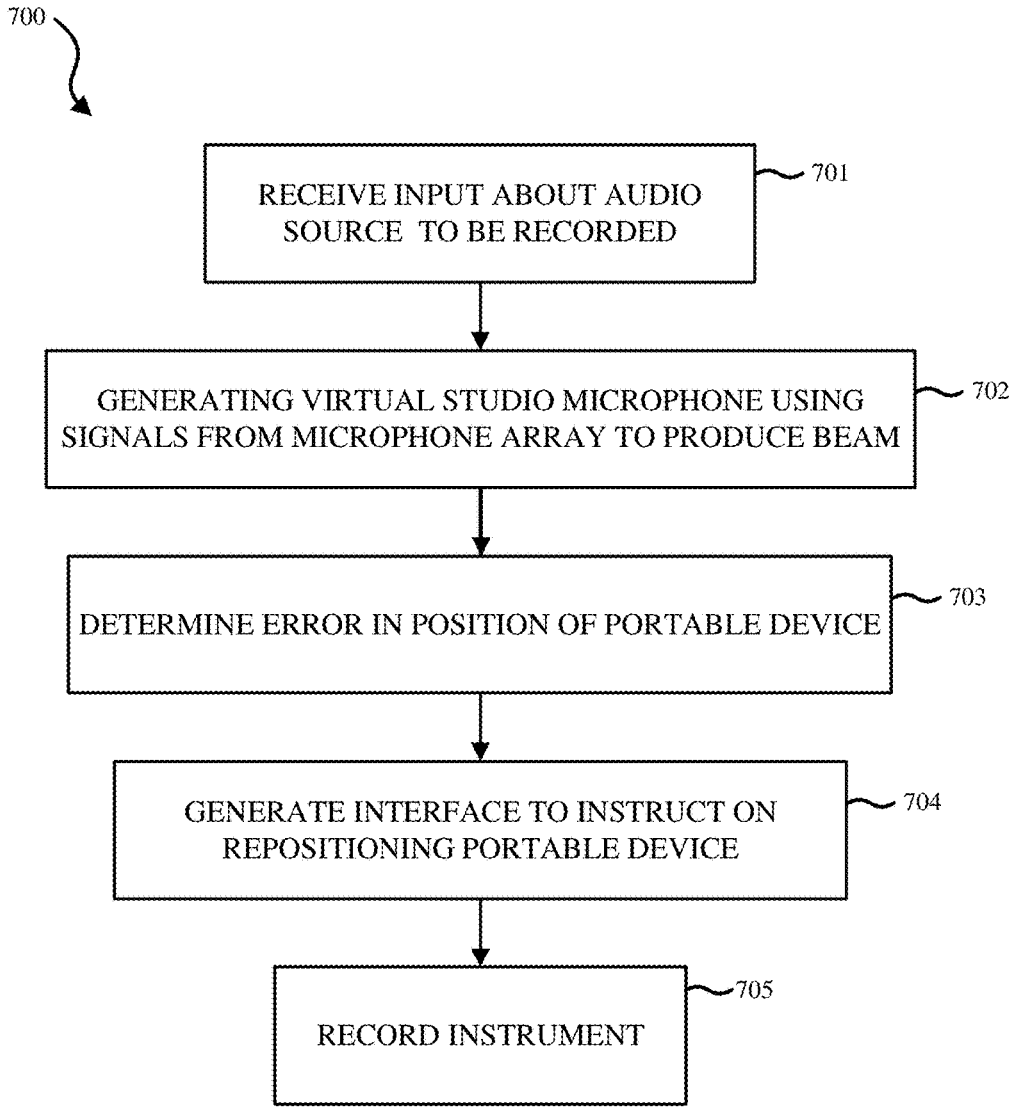
FIG. 7 is a flow chart for explaining recording of a musical instrument by a microphone array included in a portable electronic device according to an aspect.

Turning to FIG. 7, a flow diagram is illustrated for explaining generation by a portable device of a virtual studio microphone for recording an audio source (e.g., musical instrument) and for providing an interface to guide a user on device placement. In this regard, the following aspects may be described as a process 700, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc. Process 700 may be performed by processing logic that includes hardware (e.g. circuitry, dedicated logic, etc.), software (e.g., embodied on a non-transitory computer readable medium), or a combination thereof.

In the aspect of FIG. 7, at block 701 input about the particular circumstances of the recording scenario is received by the portable electronic device. The input may comprise information from one or more sensors included in the portable device, such as a camera, indicating the type of musical instrument to be recorded. Alternatively, a user may input or select the type of instrument. The type may comprise a specific kind of instrument (e.g., violin, cello, clarinet, flute, etc), and may also comprise a family of instrument (e.g., strings, woodwind, etc). Other input may also be received (from a user or from information provided by one or more sensors), such as a genre of the music to be recorded, playing style of the musician, and/or articulation by the musician of the instrument. In one aspect, a user may input desired musical qualities, such as an amount of reverberation. These inputs may be provided by the user via an interface.

At block 702, using the input received at block 701 as factors, the portable device determines a microphone configuration (directivity pattern, look-direction and equalization for each of the plurality of microphones) for the particular circumstances of the recording, based on predesigned presets, and causes the microphones to emulate the determined microphone configuration. These presets may correspond to the type or family of the instrument being recorded, and/or the playing style/articulation as well as musical genre, as received at block 701. In one aspect, a user may input preference with respect to the parameters of the microphone configuration. The microphone configuration is emulated as described above, by accessing and combining one or more signals from the microphones of the array to produce acoustic pickup beams.

At block 703, the portable device determines whether there is an error in its position. The portable device detects an error in its position based on, for example: an amplitude of one or more of the microphones signals; a signal to noise ratio measurement of one or more of the microphones signals; a direction of arrival estimation (DoA) of one or more of the microphones signals; and a left-right balance of one or more of the microphones signals. In one aspect, an amount of reverberation is considered when detecting the error. For example, the portable device may measure the reverberance of the recording space (e.g., room in which the audio source is located). In one aspect, the reverberant portion of an audio signal from the microphones is estimated. In one aspect, the reverberance may be characterized. For example, the reverberance may be characterized as diffusive (e.g., surrounding the portable device) or directional (e.g., from a specific location). The reverberance may also be generally characterized as "desired" or "undesired" based on the circumstances of the recording scenario (input at block 701).

In one aspect, at block 704, based on the configuration determined at block 702 and the error detected at block 703, an interface is generated that advises a user on whether to reposition the device and how to reposition the device, if needed. The interface is displayed on the display of the portable device. One or more sensors may be included in the portable device to provide information regarding the current position of the portable device relative to the audio source. The interface may be interactive, such that an interactive recording mode is provided where the interface aids the user in recording one or more musical instruments. In one aspect, the instructions provided by the interface are updated based on the current position of the portable device as the user is moving it. The interface may advise the user to reorient the portable device (e.g., portrait or landscape) and on how to angle the device (e.g., using arrows or text indicating a number of degrees). The instructions may advise the user to move the portable device closer or farther from the audio source, or to the left or right of the audio source, among other things. When the user reaches a position relative to the audio source that has been determined to be advantageous for recording the audio source (based on one or more factors of the circumstances of the recording scenario), the interface may advise the user to stop.

As one example, with respect to reverberance, if the audio source to be recorded is a string quartet, the portable device may determine that the reverberant portion of the audio signal is desired, and may instruct the user to move the device further from the audio source in order to increase the reverberance. If the audio source is a single musical instrument such as a saxophone, the portable device may determine that the reverberance is highly directional and may produce a beam in the direction of the audio source.

In one aspect, the interface is configured to accept updated input from the user, e.g, updating the input discussed in connection with block 701 and the microphone configuration preferences.

Figure 6B:
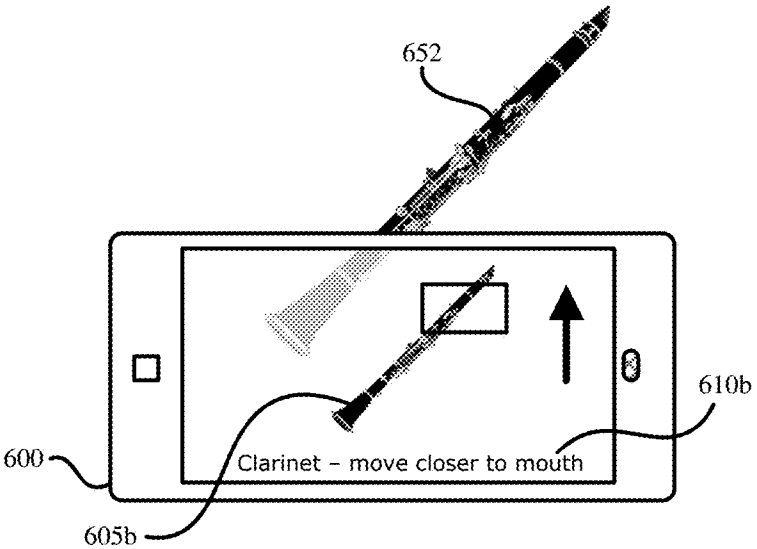
FIG. 6A to 6B are representational views for explaining a recording interface according to an aspect.
Figure 6A:
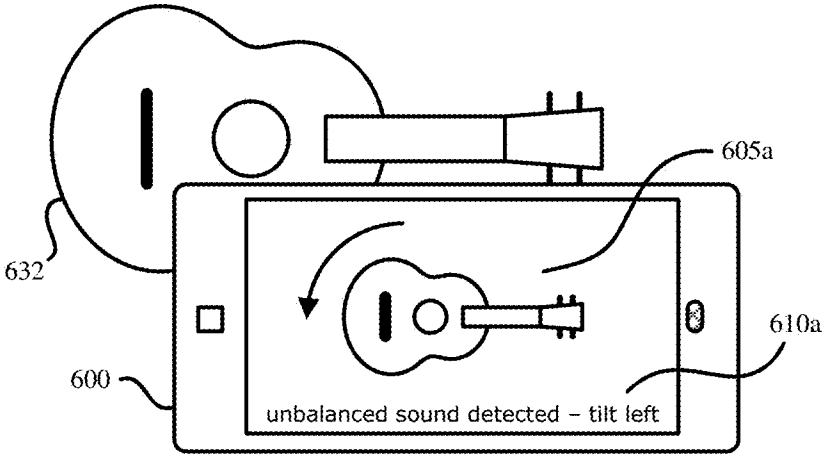

FIG. 6A illustrates one example of an interface to instruct the user on how to reposition the device based on the position information provided by the sensor, the determined configuration and the detected error. In FIG. 6A, a single acoustic guitar 632 is being recorded, and the portable device may therefore instruct the user to move it closer to the acoustic guitar 632 and configure the microphones to produce a directional beam pointed at the audio source. FIG. 6A shows two example aspects of an interface, namely a graphic 605*a* and text 610*a*, provided by portable device 600 to instruct a user on reposition the device 600 relative to the audio source 632 (e.g., acoustic guitar). The interface may include repositioning instructions advising the user regarding one or more of: reorienting the portable device (e.g., portrait or landscape), how to angle the device (e.g., using arrows or text indicating a number of degrees), whether to move closer or farther relative to the audio source, and whether to move to the left or right of the audio source. A sensor included in the device, for example a video camera, may provide information in order to determine the position of the device 600 relative to the instrument 632 being recorded. A sensor may also be included to provide information with respect to orientation of the device (e.g., an accelerometer). Additionally, visual feedback may be given by overlaying microphone positioning instructions on top of a video feed of the instrument in an augmented-reality fashion, see e.g. FIG. 6B. In FIG. 6B, the microphone positioning instructions for repositioning device 600 with respect to audio source 652 (e.g., clarinet) are comprised of graphic 605*b* and text 610*b*. In one aspect, positioning instructions may be given in the form of haptic feedback. In one aspect, positioning instructions may be given in the form of audio feedback.

At block 705, the repositioned portable device records the musical instrument using the microphone configuration determined at block 702.

Although the foregoing descriptions discuss recording a single musical instrument, it will be appreciated that the aspects described herein may be applied to recording multiple musical instruments. One such example is recording a string quartet. If input is received that the instrument to be recorded is a string quartet, the portable device may determine that reverberation is desirable and may therefore instruct the user to position the portable device at some distance (e.g., 3 feet) from the string quartet, such that the microphones can be configured to do a stereo recording. On the other hand, one advantage of using the portable device described herein to record multiple audio sources is that multiple acoustic pickup beams may be produced to separately record each of the audio sources or groups of the audio sources. The separation may be based on sound source separation or beamforming. In the example of a string quartet, 4 beams may be produced by the portable device, one to record each instrument in the ensemble. The beams may have different directivity patterns and look-directions. Alternatively, 3 beams may be produced by the portable device, one for both violins, one for the viola and one for the cello. Other configurations are also possible. In this way, the audio data available for post-production (e.g., sound mixing) may be improved, since the portable device may pick up separate sound sources. In one aspect, these separate sound sources may be labeled for easy referencing and access by the user. The label may comprise the type of sound source, either as text or as an image.

In contrast, when recording multiple sound sources in a typical professional recording studio environment, a sound engineer typically uses multiple unique microphones each having its own characteristics to record each of the different sound sources.

Thus, by virtue of the methods arrangement described herein, it is possible to simulate the multiple unique microphones typically required in a professional studio. It is also possible to provide guidance and expertise on how to use and position the portable device to achieve the simulation. A professional recording studio may therefore be simulated without the expertise of a sound engineer and without expensive professional equipment.

Figure 8:
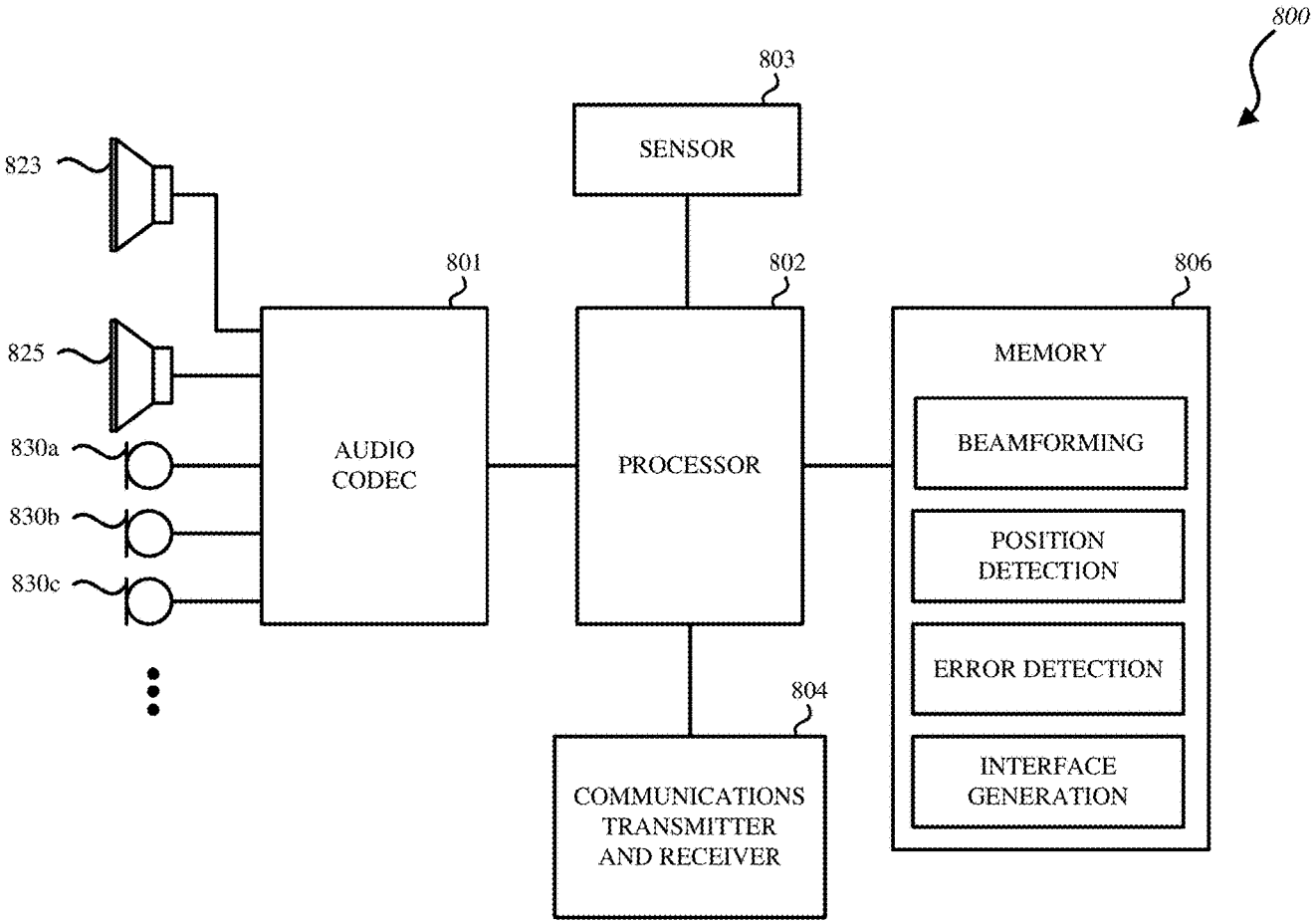
FIG. 8 illustrates an example for explaining one implementation of a portable device including a microphone array according to the first example aspect.

FIG. 8 is an example implementation 800 of the portable device described above, that has a programmed processor 802. In particular, device 800 is one example of the device 100 according to the first example aspect in which all of the processing is performed by the device 100. The components shown may be integrated within a housing such as that of a mobile phone (e.g., see FIG. 3.) These include a number microphones 830 (830*a*, 830*b*, 830*c*, . . . ) which may have a fixed geometrical relationship to each other and whose operating characteristics can be considered when configuring the processor 802 to act as a beamformer when the processor 802 accesses the microphone signals produced by the microphones 830, respectively. The microphone signals may be provided to the processor 802 and/or to a memory 806 (e.g., solid state non-volatile memory) for storage, in digital, discrete time format, by an audio codec 801. Microphones 830 may also have a fixed geometrical relationship to loudspeakers 823 and 825. A sensor 803 (e.g., still camera, video camera, accelerometer, etc.), provides information regarding the position and orientation of the portable device and to assist in repositioning of the device. Communications transmitter and receiver 804 facilitates communication with other devices.

The memory 806 has stored therein instructions that when executed by the processor 802 compute a configuration of the microphones, produce the acoustic pickup beams using the microphone signals, detect an error in the position of the microphones, provide an instruction on how to reposition the microphones, and record an instrument (as described above). The instructions that program the processor 802 to perform all of the processes described above are all referenced in FIG. 8 as being stored in the memory 806 (labeled by their descriptive names, respectively.) These instructions may alternatively be those that program the processor 802 to perform the processes, or implement the components described above. Note that some of these circuit components, and their associated digital signal processes, may be alternatively implemented by hardwired logic circuits (e.g., dedicated digital filter blocks, hardwired state machines.)

Figure 9:
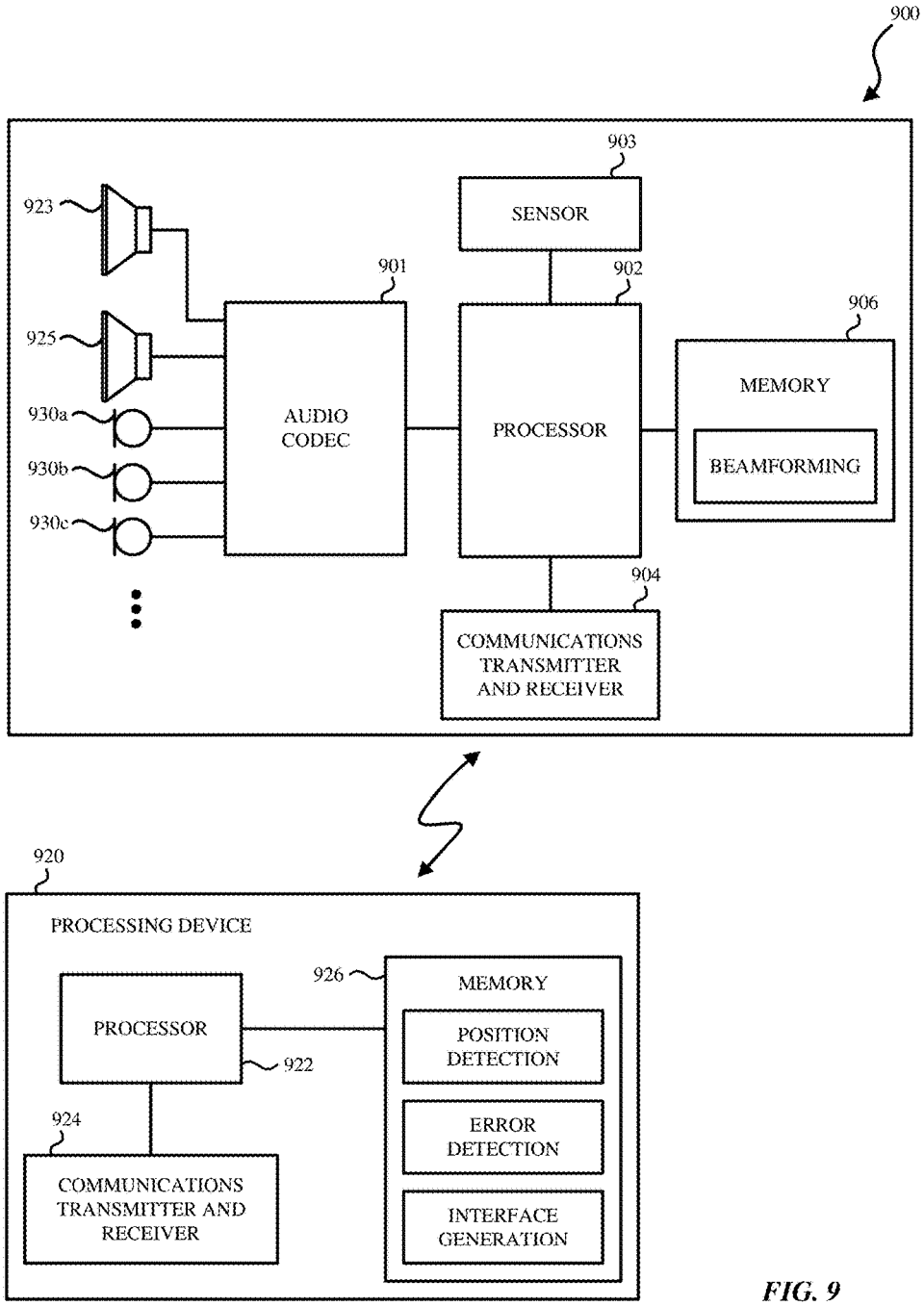
FIG. 9 illustrates an example for explaining one implementation of a portable device including a microphone array used in connection with a processing device according to the second example aspect.

FIG. 9 is an example implementation 900 of the portable device described above, that has a programmed processor 902. In particular, device 900 is one example of the device 200 according to the second example aspect in which some of the processing is performed by the device 200 and the remainder of the processing is performed by a processing device. Processing device 920 is one example of the processing device 220.

Similar to device 800, the components of device 900 may be integrated within a housing such as that of a mobile phone (e.g., see FIG. 3.) These include a number microphones 930 (930*a*, 930*b*, 930*c*, . . . ) which may have a fixed geometrical relationship to each other and whose operating characteristics can be considered when configuring the processor 902 to act as a beamformer when the processor 902 accesses the microphone signals produced by the microphones 930, respectively. The microphone signals may be provided to the processor 902 and/or to a memory 906 (e.g., solid state non-volatile memory) for storage, in digital, discrete time format, by an audio codec 901. Microphones 930 may also have a fixed geometrical relationship to loudspeakers 923 and 925. A sensor 903 (e.g., still camera, video camera, accelerometer, etc.) provides information regarding the position and orientation of the portable device and to assist in repositioning of the device. Communications transmitter and receiver 904 facilitates communication with other devices, such as portable device 920 which is communicatively coupled to the device 900, either wirelessly or via a wire.

The memory 906 has stored therein instructions that when executed by the processor 902 produce the acoustic pickup beams using the microphone signals (as described above). The instructions that program the processor 902 to perform the processes described above are all referenced in FIG. 9 as being stored in the memory 906 (labeled by their descriptive names, respectively.) These instructions may alternatively be those that program the processor 902 to perform the processes, or implement the components described above. Note that some of these circuit components, and their associated digital signal processes, may be alternatively implemented by hardwired logic circuits (e.g., dedicated digital filter blocks, hardwired state machines.)

Processing device 920 includes a processor 922, communications transmitter and receiver 924, and memory 926. The memory 926 has stored therein instructions that when executed by the processor 922 compute a configuration of the microphones, detect an error in the position of the microphones, provide an instruction on how to reposition the microphones, and cause the microphones 930 record an instrument (as described above). The instructions that program the processor 922 to perform the processes described above are all referenced in FIG. 9 as being stored in the memory 926 (labeled by their descriptive names, respectively.) These instructions may alternatively be those that program the processor 922 to perform the processes, or implement the components described above. Note that some of these circuit components, and their associated digital signal processes, may be alternatively implemented by hardwired logic circuits (e.g., dedicated digital filter blocks, hardwired state machines.)

In other aspects, the instructions discussed above are performed by a combination of the portable device 900 and the processing device 920 working together. Thus, processing device 920 performs any one or more of the instructions discussed above and the remaining instructions are performed by the portable device 900.

FIG. 8 and FIG. 9 are merely examples of particular implementations and are merely to illustrate the types of components that may be present in the audio system. While the systems 800 and 900 are illustrated with various components of a data processing system, they are not intended to represent any particular architecture or manner of interconnecting the components; as such details are not germane to the aspects herein. It will also be appreciated that network computers, handheld computers, mobile phones, servers, and/or other data processing systems which have fewer components or perhaps more components may also be used with the aspects herein. Accordingly, the processes described herein are not limited to use with the hardware and software of FIG. 8 and FIG. 9.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio system may be performed by one or more programmable processors executing one or more computer programs stored on a non-transitory computer readable storage medium to perform the functions of the system. All or part of the audio system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it is to be understood that such aspects are merely illustrative of and not restrictive on the broad invention, and the invention is not limited to the specific constructions and arrangements shown and described, since various other modifications may occur to those of ordinary skill in the art. For example, it will be appreciated that aspects of the various aspects may be practiced in combination with aspects of other aspects. The description is thus to be regarded as illustrative instead of limiting.

The invention claimed is:

1. An audio system comprising:

a housing having integrated therein a plurality of microphones having a fixed geometrical relationship to each other, wherein the housing is portable;

a sensor to provide current position information of the plurality of microphones;

a processor to access a plurality of microphone signals produced by the plurality of microphones, respectively; and memory having stored therein instructions, wherein the processor executes the instructions to generate one or more virtual studio microphones for recording an instrument, wherein the one or more virtual studio microphones are generated by:

determining a configuration of the plurality of microphones and emulating the configuration by combining one or more of the plurality of microphone signals to produce an acoustic pickup beam;

determining whether there is an error in a position of the plurality of microphones;

displaying an interface having instructions for repositioning of the plurality of microphones relative to the instrument based on the current position information provided by the sensor, the determined configuration and any determined error; and recording the instrument using the repositioned plurality of microphones and the configuration.

2. The audio system of claim 1 wherein the determination of the configuration is based on a type of the instrument.

3. The audio system of claim 1 wherein the determination of the configuration is based on articulation of the instrument.

4. The audio system of claim 1 wherein the determination of the configuration is based on a genre.

5. The audio system of claim 1 wherein the configuration includes a directivity pattern and a look-direction.

6. The audio system of claim 1 wherein determining of the error is based on at least one of: an amplitude of one or more of the plurality of microphones signals, a signal to noise ratio measurement of one or more of the plurality of microphones signals, a direction of arrival estimation of one or more of the plurality of microphones signals, a left-right balance of one or more of the plurality of microphones signals, and/or an amount of reverberation.

7. The audio system of claim 1 wherein the instructions are provided as visual feedback, audio feedback or haptic feedback.

8. The audio system of claim 1, wherein the instructions advise to adjust an orientation of the housing of the audio system to change a direction of the acoustic pickup beam relative to the instrument.

9. An audio process comprising:

sensing current position information of a plurality of microphones;

accessing a plurality of microphone signals produced by the plurality of microphones, respectively, the plurality of microphones being integrated in a housing and having a fixed geometrical relationship to each other, wherein the housing is portable; and generating one or more virtual studio microphones for recording an instrument, wherein the one or more virtual studio microphones are generated by:

determining a configuration of the plurality of microphones and emulating the configuration by combining one or more of the plurality of microphone signals to produce an acoustic pickup beam;

determining whether there is an error in a position of the plurality of microphones;

displaying an interface having instructions for repositioning of the plurality of microphones relative to the instrument based on the current position information provided by a sensor, the determined configuration and any determined error; and recording the instrument using the repositioned plurality of microphones and the configuration.

10. The audio process of claim 9 wherein the determination of the configuration is based on a type of the instrument.

11. The audio process of claim 9 wherein the determination of the configuration is based on articulation of the instrument.

12. The audio process of claim 9 wherein the determination of the configuration is based on a genre.

13. The audio process of claim 9 wherein the configuration includes a directivity pattern and a look-direction.

14. The audio process of claim 9 wherein determining of the error is based on at least one of: an amplitude of one or more of the plurality of microphones signals, a signal to noise ratio measurement of one or more of the plurality of microphones signals, a direction of arrival estimation of one or more of the plurality of microphones signals, a left-right balance of one or more of the plurality of microphones signals, and an amount of reverberation.

15. The audio process of claim 9 wherein the instructions are provided as visual feedback, audio feedback or haptic feedback.

16. A non-transitory computer-readable storage medium storing executable program instructions that when executed by a processor cause the processor to perform a method comprising:

sensing current position information of a plurality of microphones;

accessing a plurality of microphone signals produced by the plurality of microphones, respectively, the plurality of microphones being integrated in a housing and having a fixed geometrical relationship to each other, wherein the housing is portable; and generating one or more virtual studio microphones for recording an instrument, wherein the one or more virtual studio microphones are generated by:

determining a configuration of the plurality of microphones and emulating the configuration by combining one or more of the plurality of microphone signals to produce an acoustic pickup beam;

determining whether there is an error in a position of the plurality of microphones;

displaying an interface having instructions to manually adjust the housing relative to the instrument in order to reposition of the plurality of microphones from a first position relative to the instrument to a second position relative to the instrument based on the current position information provided by a sensor, the determined configuration and any determined error; and recording the instrument using the repositioned plurality of microphones and the configuration.

17. The non-transitory computer-readable storage medium of claim 16 wherein the determination of the configuration is based on a type of the instrument.

18. The non-transitory computer-readable storage medium of claim 16 wherein the determination of the configuration is based on articulation of the instrument.

19. The non-transitory computer-readable storage medium of claim 16 wherein the determination of the configuration is based on a genre.

20. The non-transitory computer-readable storage medium of claim 16 wherein the configuration includes a directivity pattern and a look-direction.

21. The non-transitory computer-readable storage medium of claim 16 wherein determining of the error is based on at least one of: an amplitude of one or more of the plurality of microphones signals, a signal to noise ratio measurement of one or more of the plurality of microphones signals, a direction of arrival estimation of one or more of the plurality of microphones signals, a left-right balance of one or more of the plurality of microphones signals, and an amount of reverberation.

* * * * *